United States Patent [19]

Schuster

[11] Patent Number: 4,750,612

[45] Date of Patent: Jun. 14, 1988

[54] COMBINATION SHIPPING AND DISPLAY CARTON

[75] Inventor: Richard L. Schuster, Monroe, La.

[73] Assignee: Manville Corporation, Denver, Colo.

[21] Appl. No.: 72,946

[22] Filed: Jul. 13, 1987

[51] Int. Cl.[4] ..... B65D 51/00

[52] U.S. Cl. ..... 206/45.29; 206/611

[58] Field of Search ..... 206/45.29, 45.28, 611, 206/631, 608

[56] References Cited

U.S. PATENT DOCUMENTS

| | | | |
|---|---|---|---|
| 1,800,091 | 4/1931 | Mayeroff et al. | 206/45.29 |
| 1,817,045 | 8/1931 | Tanner | 206/45.29 |
| 2,314,304 | 3/1943 | Brennell | 206/45.29 |
| 2,375,843 | 5/1945 | Gottlieb | 206/45.29 |
| 2,649,195 | 8/1953 | Rossi et al. | 206/45.29 |
| 2,771,986 | 11/1956 | Bekoff | 206/45.29 |
| 3,168,639 | 10/1973 | Dogliotti | 206/45.29 |

*Primary Examiner*—Joseph Man-Fu Moy

*Attorney, Agent, or Firm*—John D. Lister; Cornelius P. Quinn

[57] ABSTRACT

A combination shipping and display carton wherein the top panel is perforated adjacent one end to allow the top panel to be separated at the perforations and folded up about a fold line at its opposite end. Another fold line intermediate the ends allows the top panel to be folded upon itself so that it becomes a double thick display panel extending upwardly from the back of the panel. The carton is formed from a wrap-around blank including two top panel flaps which are overlapped to form the top panel. The top panel flaps are adhesively secured together in the overlapped area. Tuck flaps connecting the side and end panels are adhesively attached to the inner surfaces of the side panels.

10 Claims, 2 Drawing Sheets

COMBINATION SHIPPING AND DISPLAY CARTON

FIELD OF THE INVENTION

This invention relates generally to a shipping carton, and more particularly to a shipping carton which can also be used as a display carton.

BACKGROUND OF THE INVENTION

Relatively small retail articles are generally shipped to stores in shipping containers which are unloaded and then discarded. The articles after being removed are then stocked on the shelves. Some items, instead of being individually stocked, are set out in special display cartons to attract attention to the products. Although display cartons add to the cost of merchandising, they have been found to be effective sales tools for certain types of articles and worth the extra packaging expense. The cost of shipping the display packages is increased substantially, however, by the containers in which they are sent. Such containers are usually formed of thick corrugated board, and can be quite expensive.

It would be desirable from the standpoint of cost and effective handling procedures to be able to ship such products in the same carton in which they will be displayed. This would under normal conditions be a difficult design problem since the carton would have to be strong enough to withstand the stresses of shipping and yet be versatile and attractive enough to function as a display carton. Complicating the problem, however, is the fact that many of the items best sold through a display package are contained in wrap-around cartons. These are cartons formed by high speed packaging machines which wrap carton blanks around prearranged groups of articles traveling through the machine. Because the relatively thin paperboard commonly used for this purpose and the high forming speed of the machine would normally be thought to dictate against it, the use of a wrap-around carton as a cost-effective combination shipping and display carton has heretofore not been practical.

BRIEF SUMMARY OF THE INVENTION

This invention provides a combination shipping and display carton which has a substantially rectangular bottom panel, two opposite end panels foldably connected to the bottom panel and two opposite side panels also foldably connected to the bottom panel. A top panel foldably connected to the upper portions of the side panels is perforated substantially across its width in the vicinity of one of the side panels. The top panel further contains a fold line intermediate the side panels. When the top panel is separated along the perforations it can then be pivoted upwardly about its foldable connection to the opposite side panel and downwardly about its intermediate fold line to create a display panel extending upwardly from the back of the carton.

Other features are also significant. The side and end panels are connected by tuck flaps which are adhered to the inside face of the side panels to strengthen the carton. The top panel is formed from overlapping inner and outer top panel flaps which are adhered to each other in the area of the overlapping and which permit the packaging machine to form the combination shipping and display wrap-around carton.

These and other features and aspects of the invention, as well as its many benefits, will be made clear in the more detailed description of the invention which follows.

DESCRIPTION OF THE INVENTION

Figure 1:
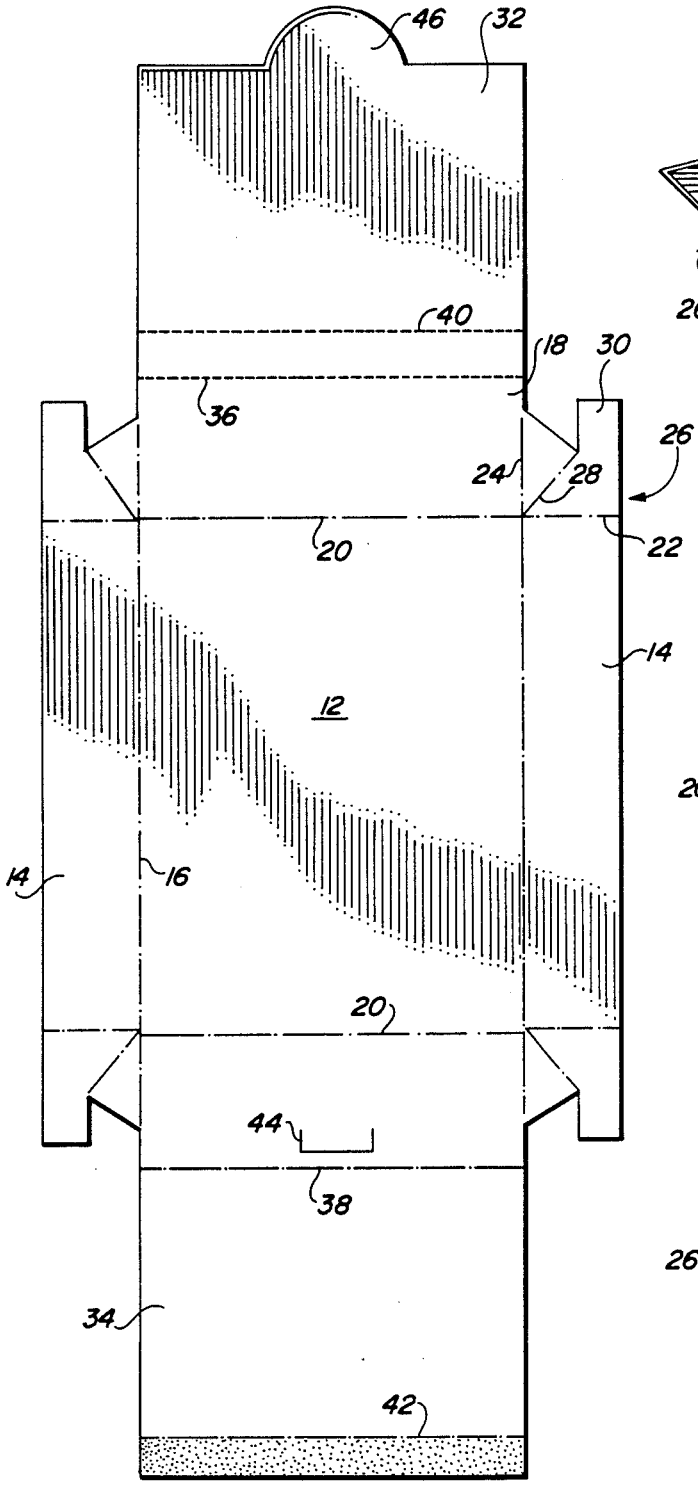
FIG. 1 is a plan view of a production blank from which the carton of the present invention is formed.

Referring to FIG. 1, the blank 10 comprises a generally rectangular central section 12, opposite ends of which are connected to end sections 14 by score lines 16. The remaining sides of the central section are connected to intermediate sections 18 by score lines 20. The central section 12 corresponds to the bottom panel of the carton formed from the blank, while the end and intermediate sections 14 and 18 correspond to the end and side panels, respectively.

Connecting the end sections along score lines 22 and the intermediate sections along score lines 24 are tuck flaps 26. The tuck flaps are further connected to the ends of score lines 22 by tuck score lines 28. This arrangement allows the tuck flaps to fold inwardly about tuck score lines 28 when the blank is formed into a carton. The tuck flaps further have extensions 30 which are adapted to contact a substantial portion of the width of the inner surface of the side panels formed from the intermediate sections so that upon being glued to the side panels a strong bond results.

Still referring to FIG. 1, the blank further includes end flaps 32 and 34 connected by score lines 36 and 38 to the intermediate sections 18. The end flaps correspond to the top panel flaps used to form the top panel of the carton. As illustrated, end flap 32 corresponds to the outer top panel flap of the carton and end flap 34 corresponds to the inner top flap of the carton. Thus the end flap 32 is somewhat longer than the end flap 34 to enable the outer top panel flap to overlap the inner top panel flap.

Spaced outwardly a short distance from the score line 36 is a perforated line 40 to enable the top panel of the carton to be separated along this line. The score line 36 is also perforated so that the material between the perforated lines can function as a tear strip. Spaced inwardly from the end of the end flap 34 is score line 42 which enables the top panel of the carton to be folded along this line. In addition, a U-shaped slit 44 is provided in the intermediate section 18 adjacent the score line 38. The purpose of the score line 42 and the slit 44 will be made clear hereinafter.

Extending from the end of the end flap 32 is a portion 46 which is designed to extend upwardly at the top of the display panel of the carton for display purposes. The manner in which this extension is made to project upwardly will also be made clear hereinafter.

Figure 2A:
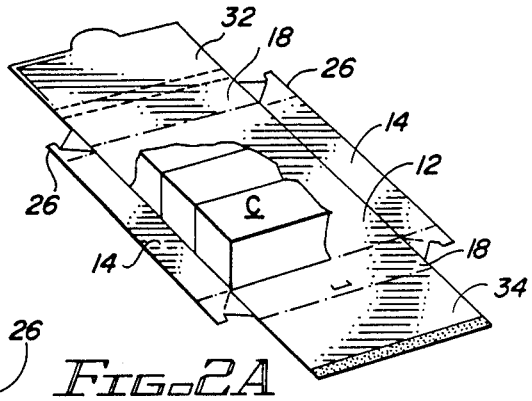
FIGS. 2A to 2E are pictorial representations of the carton blank of FIG. 1, showing in sequence the steps by which the blank is folded by a packaging machine to form the carton of the present invention.

Referring to FIG. 2A, the blank 10 is shown in its initial position as it begins to move through the packaging machine, not shown. Note that the end panels 14 are in the leading and trailing positions and that the articles to be packaged, shown in partial outline, are supported on the bottom section of the blank. In this case the articles comprise four packs of elongated rectangular containers C of the type used to package golf balls, which will have been positioned on the blank by a feeding mechanism which is well known in the art and is not significant to the invention.

Figure 2B:
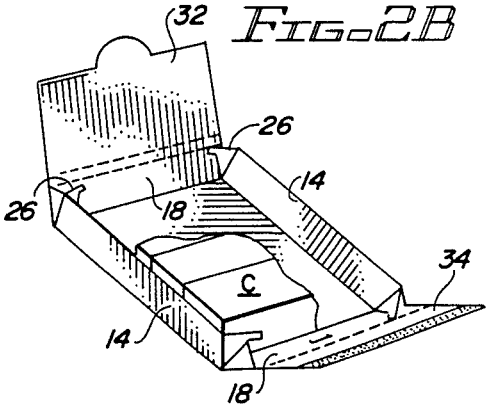
Figure 2C:
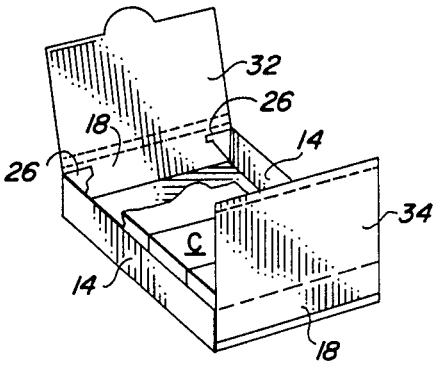

At the next stage in the machine, illustrated in FIG. 2B, fingers on the machine, not shown, have folded the tuck flaps 26 upwardly and inwardly toward each other, causing the end sections 14 and the intermediate sections 18 to be folded up about their score lines. FIG. 2C shows the blank after the end sections and the intermediate sections have been folded up to their fully vertical position. It will be understood that although the gluing step has not been shown, the tuck flaps will have been glued to the inner surface of the end sections by means well known in the art. The glue can be any type that will bond the elements together in the short period of time between application of the glue and the exit of the carton from the package formation area, specific hot melt adhesives and cold adhesives suitable for the purpose being well known in the art.

Figure 2D:
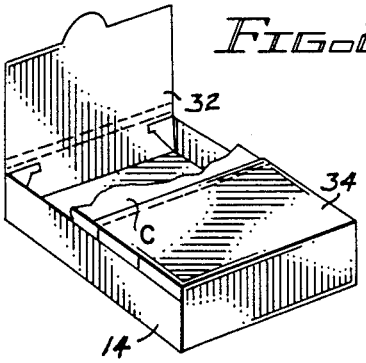
Figure 2E:
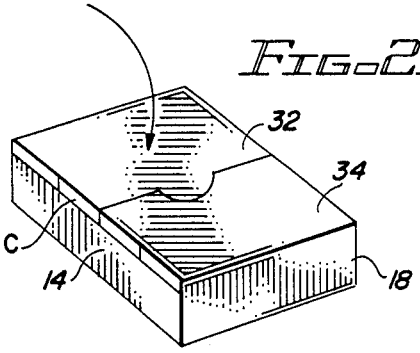

As shown in FIG. 2D, the next step in the formation of the carton is to fold over end flap 34 to form the inner top panel flap. In FIG. 2E the finished carton 50 has been completed by folding over the end flap 32 so that it overlaps and adheres to the flap 34 and becomes the outer top panel flap. The adhesive used to adhere the flaps together may also be any suitable adhesive, such as the hot melt adhesive used on the tuck flaps. The area of the inner top panel flap to which the overlapping portion of the outer top panel flap is adhered is the area shown in FIG. 1 between the score line 42 and the end of the flap 34. As can be seen, the perforated line 40 is inwardly spaced from the combination fold/perforation line 36 so that the sheet material therebetween can function as a tear strip.

Figure 3:
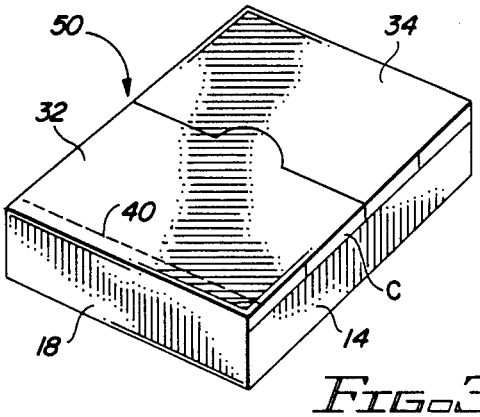
FIG. 3 is a pictorial representation of the carton of FIG. 2E, illustrating it from a different point of view.

Referring to FIG. 3, it will be seen that the end panels 14 do not extend all the way up to the edge of the top panel, thereby exposing the upper portions of the article containers C. This is preferred because it allows a better view of the containers when the display carton has been set up. If the particular article or container being shipped does not lend itself well to this type of display, it should be understood that the end panels could be made higher, allowing them to extend all the way up to the top panel if desired.

Figure 4:
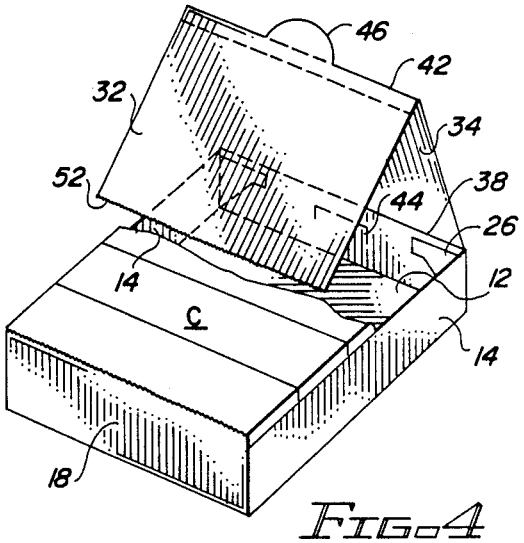
FIG. 4 is a view similar to that of FIG. 3, but showing the top panel in the process of being folded after it has been separated from the side panel.

Referring to both FIGS. 3 and 4, the first step in converting the fully wrapped shipping carton 50 to a display carton is to remove the tear strip bounded by the perforated lines 36 and 40, creating a free top panel edge 52. The top panel is then folded upwardly about the score line 38, and the outer top panel flap 32 is folded downwardly about the score line 42. It will be recalled that the otuer top panel flap 32 has been glued to the inner top panel flap 34 in the portion overlapped by the outer top panel flap. In the illustrated embodiment the overlapped portion is the area between the end of the inner top panel flap 34 and the score line 42, enabling the top panel to be folded downwardly intermediate the two side panels 18 as shown in FIG. 4. This arrangement results in the projecting portion 46, which has not been glued to the inner top panel flap, to remaining in the plane of the outer top panel flap 32 and extending beyond the score line 42.

Figure 5:
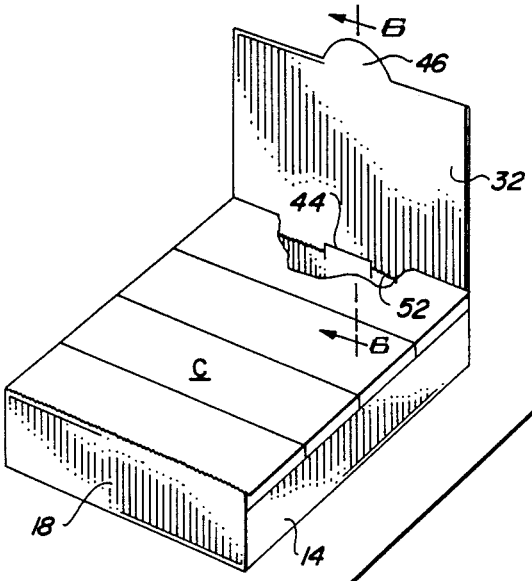
FIG. 5 is a view similar to that of FIG. 4, but showing the carton in its display form after the top panel has been folded into place to function as a display panel.

The completely formed display carton shown in FIG. 5 results from the continued folding of the top panel about score lines 38 and 42 until the inner surfaces of the outer and inner top panel flaps are in substantially opposed backto back relationship. The opposed top panel flaps when in their upright position function as a display panel, with any graphics or printed material on the outer surface of the flap 32 being presented on the face of the display panel. Thus the printing of a separate display panel is not necessary. Further, as a part of the display panel the projecting portion 46 extends upwardly, acting to attract attention to the display. In the embodiment illustrated, the projecting portion is shaped to resemble a golf ball, or a portion of a golf ball, thereby attracting attention to the golf ball package display. Of course it is not necessary that this feature be utilized, but the design of the invention permits it to be furnished if desired.

Figure 6:
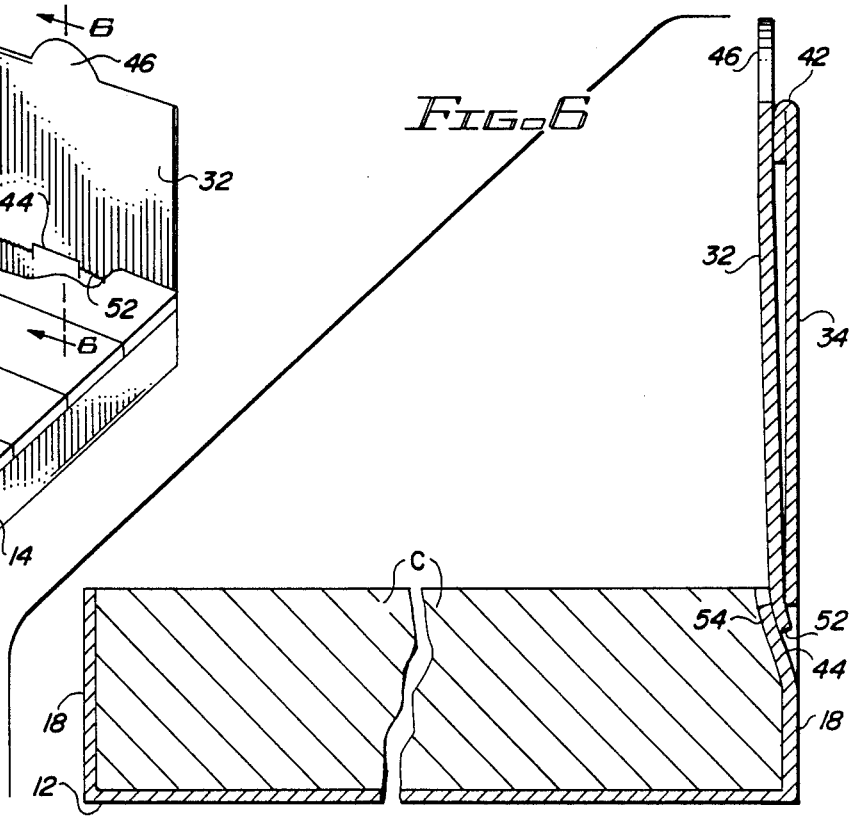
FIG. 6 is a transverse sectional view taken along line 6—6 of FIG. 5, showing the means by which the display panel is held in its upright position.

The display panel is held in its upright position by fitting the bottom or free edge 52 of the outer top panel flap 32 in the slit 44 in the side panel 18 at the back of the carton. Thus, as shown in FIG. 6, the edge 52 is secured in the slit between the back side panel 18 and the small tab 54 formed by the surrounding slit.

The location of the score line 42 need not be limited to the position shown. This can be varied, depending upon the location of the slit 44 and the length of the top panel. Also, although the arrangement shown is preferred because of the ability to provide a vertical projection on the display panel, it is possible to reverse the overlap so that the top panel flap 32 can be the inner top panel flap instead of the outer top panel flap as illustrated.

It should now be understood that the invention provides a simple carton design which allows relatively thin economical paperboard to be used, yet results in a carton strong enough to function as a shipping carton. Further, the same carton also converts quite easily to an attractive functional display carton which displays the contents of the carton and at the same time presents a display panel at the back of the carton. Although the embodiment of the invention disclosed is directed to a display carton designed to ship and display golf ball packets, obviously the main principles of the invention could be incorporated in cartons for shipping and displaying other types of products as well.

It can also be understood from the foregoing that in addition to the modifications discussed above, it is possible to make other changes to certain specific details of the carton without departing from the spirit and scope of the invention.

What is claimed is:

1. A combination shipping and display wrap-around carton, comprising:

a substantially rectangular bottom panel having two opposite end edges and two opposite side edges;

two opposite end panels, each being foldably connected to one of the end edges of the bottom panel;

two opposite side panels, each being foldably connected to one of the side edges of the bottom panel;

a top panel comprised of two overlapping top panel flaps adhered together, one of the flaps being foldably connected to the upper portion of one of the side panels and the other flap being foldably connected to the upper portion of the other side panel;

said one top panel flap being perforated in the vicinity of said one side panel, the perforations extending substantially the full width of the top panel to enable the top panel to be separated along the perforations; and the top panel having a fold line in one of the top panel flaps intermediate the side panels, the intermediate fold line extending substantially the full width of the top panel;

whereby the top panel is adapted to be separated along the perforations, folded upwardly about its foldable connection to the other side panel, and folded downwardly about its intermediate fold line to form a display panel extending upwardly from the other side panel.

2. A combination shipping and display carton according to claim 1, wherein the perforations enabling the top panel to be separated comprise part of a tear strip.

3. A combination shipping and display carton according to claim 1, wherein the intermediate fold line is in the inner top panel flap in the vicinity of the overlying end of the outer top panel flap.

4. A combination shipping and display carton according to claim 3, wherein a portion of the outer top panel flap extends beyond the intermediate fold line in the inner top panel flap and is not adhered to the inner top panel flap.

5. A combination shipping and display carton according to claim 1, wherein the end panels and side panels are connected by tuck flaps which hold the end panels in an upright position and wherein the tuck flaps include tabs extending inwardly toward each other, the tabs being adhesively secured to the inner faces of the side panels.

6. A production blank for forming a wrap-around combination article shipping and display carton, comprising:

a sheet having a substantially rectangular central section corresponding to the bottom panel of a carton formed from the blank;

two end sections connected by score lines to opposite edges of the central section, the end sections being adapted to be folded up about articles positioned on the central section to form the end panels of a carton formed from the blank;

two intermediate sections connected by score lines to the other opposite edges of the central section, the intermediate sections being adapted to be folded up about articles positioned on the central section to form the side panels of a carton formed from the blank;

two end flaps connected by score lines to the edges of the intermediate sections opposite the edges connected to the central section, one of the end flaps being longer than the other end flap, the end flaps being adapted to be folded over articles positioned on the central section to form inner and outer top panel flaps which when adhered together in the overlapping area form the top panel of a carton formed from the blank;

one of the end flaps being perforated substantially across its width in the vicinity of the score line connecting said one end flap to one of the intermediate sections to enable the top panel of a carton formed from the blank to be separated along the perforations; and one of the end flaps having a fold line extending substantially the full width thereof, the fold line being located intermediate the side panels in a carton formed from the blank;

whereby the top panel of a carton formed from the blank is adapted to be separated along the perforations, folded upwardly about the score line connecting the top panel to the opposite side panel, and folded downwardly about the intermediate fold line in the top panel to form a display panel extending upwardly from the opposite side panel.

7. A production blank for forming a combination shipping and display carton according to claim 6, wherein the perforations are in the end flap corresponding to the outer top panel flap.

8. A production blank for forming a combination shipping and display carton according to claim 6, wherein the fold line in one of the end flaps is in the end flap corresponding to the inner top panel flap near the free end thereof.

9. A production blank for forming a combination shipping and display carton according to claim 8, wherein the end flap corresponding to the outer top panel flap is dimensioned such that a portion thereof extends beyond the fold line in the inner top panel flap of a carton formed from the blank, the extending portion not being adhered to the inner top panel flap.

10. A production blank for forming a combination shipping and display carton according to claim 6, wherein the end sections and the intermediate sections are connected by tuck flaps, the tuck flaps being adapted to be adhesively secured to the inner faces of the side panels of a carton formed from the blank.

* * * * *